United States Patent [19]

Hanafi

[11] 4,392,784

[45] Jul. 12, 1983

[54] VALVE ARRANGEMENT FOR VENTING CONDUITS AND PUMPING SYSTEM INCLUDING THE SAME

[75] Inventor: Nabil Hanafi, Urach, Fed. Rep. of Germany

[73] Assignee: Pumpenfabrik Urach, Urach, Fed. Rep. of Germany

[21] Appl. No.: 309,123

[22] Filed: Oct. 5, 1981

[30] Foreign Application Priority Data

Oct. 28, 1980 [DE] Fed. Rep. of Germany ..... 3040478

[51] Int. Cl.[3] ..... F04B 9/10

[52] U.S. Cl. ..... 417/103; 417/388; 417/435; 137/567

[58] Field of Search ..... 417/102, 103, 252, 265, 417/385, 388, 92, 387, 435; 137/567

[56] References Cited

U.S. PATENT DOCUMENTS

| | | | |
|---|---|---|---|
| 2,046,228 | 6/1936 | Wiedmann et al. | 137/517 |
| 3,743,444 | 7/1973 | Kazama et al. | 417/385 |
| 4,304,527 | 12/1981 | Jewell et al. | 417/103 |

*Primary Examiner*—Richard E. Gluck
*Assistant Examiner*—Paul F. Neils
*Attorney, Agent, or Firm*—Michael J. Striker

[57] ABSTRACT

A valve arrangement for venting conduits in pumping systems having several pumping units for delivering a gas or vapor generating liquid includes a double-seat valve in which the valving element moves between two extreme closing positions and an intermediate position in which the venting conduit is momentarily open; as the venting conduit is connected at one end with the gas collecting zone in one pumping unit and at the opposite end with the liquid discharging zone below the delivery valve so that the double seat valve is automatically controlled by the pressure difference resulting due to different operational phases of the pumping system.

14 Claims, 7 Drawing Figures

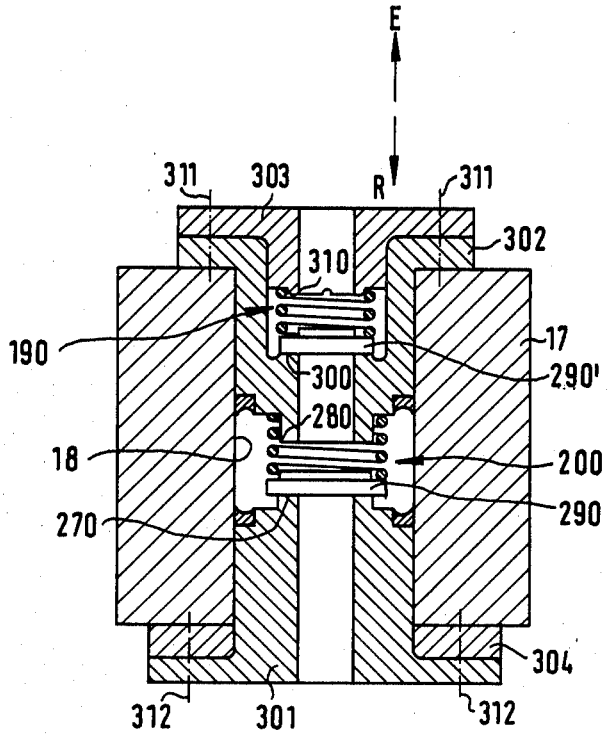
Fig. 6
Fig. 7
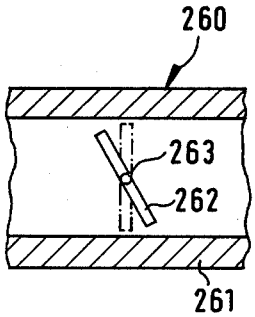

VALVE ARRANGEMENT FOR VENTING CONDUITS AND PUMPING SYSTEM INCLUDING THE SAME

BACKGROUND OF THE INVENTION

The present invention relates in general to pressure relieving valves, and in particular to a valve arrangement for a venting conduit, particularly for use in connection with pumps delivering gas- or vapor-forming liquid.

Gas or vapor bubbles in a liquid are prone to collapse suddenly when pressure of the liquid is increased, whereby powerful shockwaves in the liquid are generated resulting in overloads of machine parts conducting the liquid. Particularly the inlet and delivery valves in pumping systems are sensitive to such excessive loads and may become damaged or even destroyed.

Pumps are known which are provided with venting conduits branching from a zone of the working space of the pump in which gases or vapors are collected. To each venting conduit is assigned a special auxiliary pump which is conducted for delivery of mixtures of gases or vapors with the liquid and which feeds this mixture from the collecting zone into the pressure conduit of the pump. The disadvantage of such an auxiliary venting pump is its expensive design because the pump must be capable of delivering without interference both gas and liquids.

Instead of the auxiliary pump it has been also devised to provide the main pump with a venting conduit connecting the gas or vapor collecting zone of the main pump to its pressure conduits. The venting conduit cooperates with a backpressure or pressure relieving valve which is permanently opened in the venting direction and closed in the backpressure direction. The pressure relieving valve, however, must be capable to open at a smaller pressure difference than the delivery valve of the main pump arranged between the liquid discharge zone of the working space and the pressure conduit. This mutual adjustment of the pressure relieving valve and of the delivery valve usually necessitates to design the delivery valve with a relatively high resistance and consequently the main pump must operate with a relatively high power.

SUMMARY OF THE INVENTION

It is, therefore, a general object of the present invention to overcome the aforementioned disadvantages.

More particularly, it is an object of the invention to provide a pressure relieving valve arrangement for a venting conduit which avoids the use of additional venting pumps without any limitations in the design of delivery valves in the device to be vented.

In keeping with these objects, and others which will become apparent hereafter, one feature of the invention resides in the provision of a double-seat pressure relieving valve with the seats arranged in tandem and having a valving element which is movable in two opposite directions between a first closing position in which it rests on one seat and the valve is closed, an intermediate position between the seats in which the valve is open, and a second closing position in which the valving element rests on the other seat and the valve is closed.

When at a pressure drop in the working space of the pump the valving element is lifted from its first closing position into the intermediate position, a large amount of trapped gas or vapor during this transitory opening of the valve is discharged whereas the trailing liquid enters the valving element and tends to press the same on the other seat to resume its second closing position. In this manner an advantage results that a relatively small amount of the liquid leaks through the gas or vapor discharge ports of the double seat pressure relieving valve.

As soon as the pressure drop in the venting direction discontinues, backpressure load is sufficient to return the valving element again into its first closing position in sealing engagement with the first seat and consequently the gases or vapors escaping through the venting conduit are prevented from reentering the pressure release collecting zone of the working space.

When the direction of movement of the valving element and the occurrence of pressure drops varies at a very high rate, for example, in the case of high speed working machines such as pumps and the like, it is of advantage when the double seat pressure relieving valve is combined with another backpressure valve arranged in tandem with the other seat in the venting direction. The additional pressure relieving valve closes immediately after the exhaust of the trapped gas or vapors, when the valving element of the double seat valve is displaced into its second closing position in engagement with the other seat; the additional pressure relieving valve insures that during the time interval when the valving element of the double seat valve moves toward its first closing position, no pressure liquid escapes through the venting conduit.

Preferably, a throttle is arranged upstream of the double seat valve arrangement. This throttle imposes a negligible resistance to gases or vapors but a high resistance to the liquid thus substantially reducing the amount of liquid which might escape through the venting conduits. In a preferred embodiment of this invention, the resistance of the throttle is adjustable.

In addition, the path of movement of the valving element of the double seat valve is also adjustable to match the time point of opening of the double seat valve and the transmission coefficient of the valve to different operational conditions. In the latter embodiment of the double seat valve having an adjustable stroke the valving element is preferably spring biased in the backpressure direction to insure that even at high strokes the valving element is returned without trouble into its starting position.

At lower strokes it is sufficient when the valving element both of the double seat valve and of the additional backpressure valve is returned into its first closing position in engagement with the first seat by the force of gravity.

In the case when the gas or vapor forming liquid contains solid pollutants, such as, for example, in the case of sludges or the like, it is advantageous when the valving element is in the form of a ball cooperating with fitting valve seat. A valve design of this kind is relatively immune to pollutants so that sufficient seal is always insured.

In the case of clean liquids, such as for example gases in liquid state, the valve arrangement is provided with advantage with a disc-shaped valving element cooperating with a flat seat. The valve discs or plates insure an excellent seat and a well reproducible operational behavior.

According to another feature of this invention the double seat valve of the combined arrangement of the double seat valve and the additional backpressure valve can be arranged in gangs one after the other in each venting conduit, for example doubled in order to increase the operational safety. This repeated arrangement is advantageous since an incorrect operation of the venting conduit is not immediately depicted; on the other hand, the efficiency of the working machine due to this redundant arrangement is decreased.

The valve arrangement according to this invention is applicable for devices of any kind. Of particular advantage is their installation in pumping systems.

In pumping systems including a plurality of pumps units having respectively reciprocating pump elements operating at different phases, a working space formed with a gas or vapor collecting zone and a liquid discharging zone, a suction conduit with an inlet valve and a pressure conduit with a delivery valve communicating with the liquid discharge zone, it is of advantage when the venting conduit provided with the double seat valve arrangement of this invention connects the gas or vapor collecting zone of one pumping unit with the liquid displacing zone of the subsequent pumping unit operating at a different phase, the venting conduit opening into the liquid displacing zone downstream of the delivery valve. The phase shift between the consecutive pumping units is utilized in such a manner that while one pumping unit is in its suction phase it exhausts gas or vapor from the collecting zone of the other pumping unit which is in its compression phase and vice versa. According to the pressure difference between the suction and compression phases, a considerable pressure drop is developed in the venting conduit and consequently the double seat valve arrangement in the venting conduit reliably opens and venting operation is effective even at the pumps which deliver a very viscous liquid or sludges. For the same reason, namely due to the considerable pressure drop, the venting conduit operates even in the case when relatively large amounts of solid pollutants are exhausted together with the gas or vapor and the danger of clogging is minimized.

Due to the fact that the venting conduit is connected at one end thereof to one pump unit and opens into the liquid discharge zone below the delivery valve, and at the other end opens into the gas or vapor collecting zone of the other pump unit operating as a different phase, the accumulated gases or vapors are discharged by the double seat valve during the subsequent compression phase of the first-mentioned pump unit.

This connection of venting conduits is applicable for any pumping system having a plurality of pump units operating at different phase shifts such as horizontal piston pumps with a plurality of cylinders. The phase shift between the vented and venting pumping units can be relatively small provided that a pressure drop sufficient for the venting operation is built up during this particular time interval. Nevertheless, in the preferred embodiment the venting conduits are connected to respective pumping units in such a manner that the phase shift between the interconnected units be between one-quarter to one-half of the working cycle. In the latter case the suction phase of the first pumping unit overlaps completely the compression phase of the other pumping unit.

Proper venting is of particular importance in piston pumps provided with a so-called reciprocating or oscillating working spaces which receive a non-aggressive separation fluid from transmitting the movement of pistons on the pumped medium so that the latter is spaced apart from the pistons. Since the separation fluid in its reciprocating space is replaced only very slowly, considerable amounts of gas or vapor can be accumulated in their reciprocating spaces during a prolongated operation of the pumping system and in an extreme case the accumulated gas or vapor due to their compressibility may render the work of pump and pistons or other pumping elements ineffective thus causing considerable disturbances in the operation of the whole pumping system.

Venting conduits provided with relieving double-seat valves of this invention make it possible that the individual pumping units in a pumping system vent each other. With regard to structural simplicity and good efficiency of the system it is advantageous when the double-seat valves of this invention are installed directly in the venting conduit. This arrangement, however, is not unconditionally necessary. For instance, the venting conduits can be controlled by double-seat valves actuated by a separate drive. Provided that a lower efficiency of the pumping system is acceptable, it is sufficient when only the backpressure valves are arranged in the venting conduits so that the latter in the venting direction are permanently open. In this case the efficiency is reduced proportionally to throttling action of the venting conduits.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 6 shows in an axial section a combination of a double seat valve and a back pressure valve, including spring loaded plate-like valving elements; and FIG. 7 shows an adjustable throttling device for use with the valves of this inventions.

DESCRIPTION OF THE PREFERRED EMBODIMENTS

Figure 1:
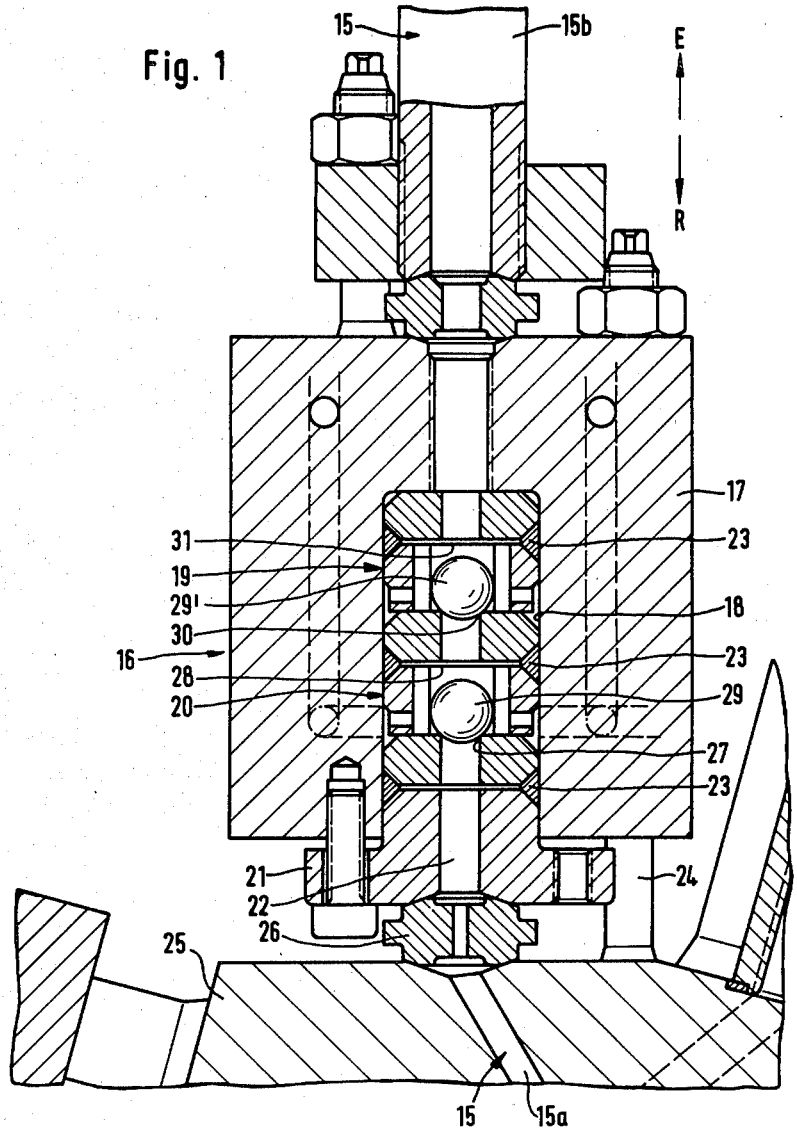
FIG. 1 is an axial cross-section of the valve arrangement of this invention.

Referring firstly to FIG. 1, it will be seen that for controlling the passage through a venting conduit 15 a valve arrangement 16 is arranged between the sections 15*a* and 15*b* of the venting conduit. The section 15*a* communicates with a gas or vapor collecting zone of a system to be vented.

The valve arrangement 16 includes a housing 17 secured by an anchoring rod 24 to housing 25 of the device to be vented.

Housing 17 of the valve arrangement is formed with a stepped throughbore 18 which accommodates in its section of larger diameter two double-seat valves 19 and 20. Cover plate 21 formed with a central bore 22 and with sealing ring 23 covers the opening of the throughbore 18 of larger cross-section and is fastened to housing 17 by screws.

Arrow E indicates venting direction whereas arrow R indicates backpressure direction. Upstream of the doubleseat valve 20 when considered in the direction E is arranged a throttle 26; preferably, the throttle 26 is clamped between the cover plate 21 and the machine housing 25 by the anchoring bolt 24.

In this embodiment, the first valve 20 has a lower valve seat 27 of circular cross-section and an upper valve seat 28 of the same shape; both valve seats cooperate with a spherical valving element 29 which has a smaller diameter than the spacing between the two valve seats. In other words, valve arrangement 20 is in the form of a double-seat valve with seats arranged in tandem so that valve ball 29 closes the passage both in the venting direction E and in the backpressure direction R and opens the venting conduit 15 only at the instant when the valving element 29 is in its intermediate position between the valve seats 27 and 28. The second valve 19 corresponds in structure to the valve 20 and includes spherical valving element 29' which in the backpressure direction R rests on a circular valve seat 30 and when lifted engages the upper valve seat 31. By contrast to the valve arrangement 20, however, the uppermost valve seat 31 even if in full engagement with valving element 29' does not fully close the passage in the conduit 15 and consequently the valve 19 acts as a conventional backpressure valve which fully closes the conduit 15 only in the direction R when the valving element 29' rests on the valve seat 30.

The operation of the valve arrangement 16 is as follows:

If overpressure occurs in the conduit section **15*a* with respect to the conduit section 15*b* of the venting conduit, both valving balls 29 and 29' are lifted from their respective lower seats 27 and 30 whereby gas or vapor bubbles present in the lower conduit section 15*a* escape at high speed through the throttle 26 and the open valves 20 and 19 into the conduit section 15*b* because gaseous or vaporized substances do not encounter large resistance when passing through the throttle 26 and the open valves. By contrast, however, the flow speed of the liquid following the gas or vapors is substantially reduced by the throttle 26. Liquid passing through the valve 20 and 19 entrains due to its relatively large viscosity in comparison with gases or vapors, the valving balls 29 and 29' and presses the same against the upper seat 28 and 31. As a consequence, the double-seat vale 20 is closed in the venting direction E and pressure differences acting from opposite sides from the upper valving ball 29' due to the non-sealing abutment seat 31 are equalized so that ball 29' drops by its own weight on its lower seat 30 and the venting conduit 15** is closed in the backpressure direction.

As soon as pressure in the conduit section **15*a* drops below the pressure in the upper conduit section 15*b*, the venting ball 29 of the double-seat valve arrangement 20 sinks into its initial closing position in engagement with its lower seat 27 whereby the closed backpressure valve 19 prevents any return of gases or vapors which have been previously discharged through the valve arrangement 16**. In the following pressure alternating cycle, the aforedescribed process is repeated.

The uppermost valve seat 31 of the backpressure valve 19 has its sealing edge interrupted by radial grooves insuring the described non-sealing quality of the seat. Instead of this measure it is also possible to provide a by-pass channel in the valve 19 before establishing communication with the section **15*a* even when the seat 31** is closed.

To increase operational reliability, the valve arrangements including both the double-seat valve 20 and the backpressure valve 19 can be used in multiples in a single venting conduit.

In the embodiment according to FIG. 1, the valving balls 29 and 29' are returned into their closing positions in the direction R by the force of gravity only. In addition, there may be provided biasing springs for returning the valve balls into their first closing position so that the whole valve arrangement can be used in any position. The valve arrangement of this invention is applicable in any type of hydraulic or pneumatic machine, for example, in hydraulic driving machines or in driven machines such as pumps. For example, as it will be disclosed below, the valve arrangement of FIG. 1 can be used for venting a piston pump having venting conduits opening simply into the outer atmosphere or in a reservoir having a constant pressure, is desired.

Figure 2:
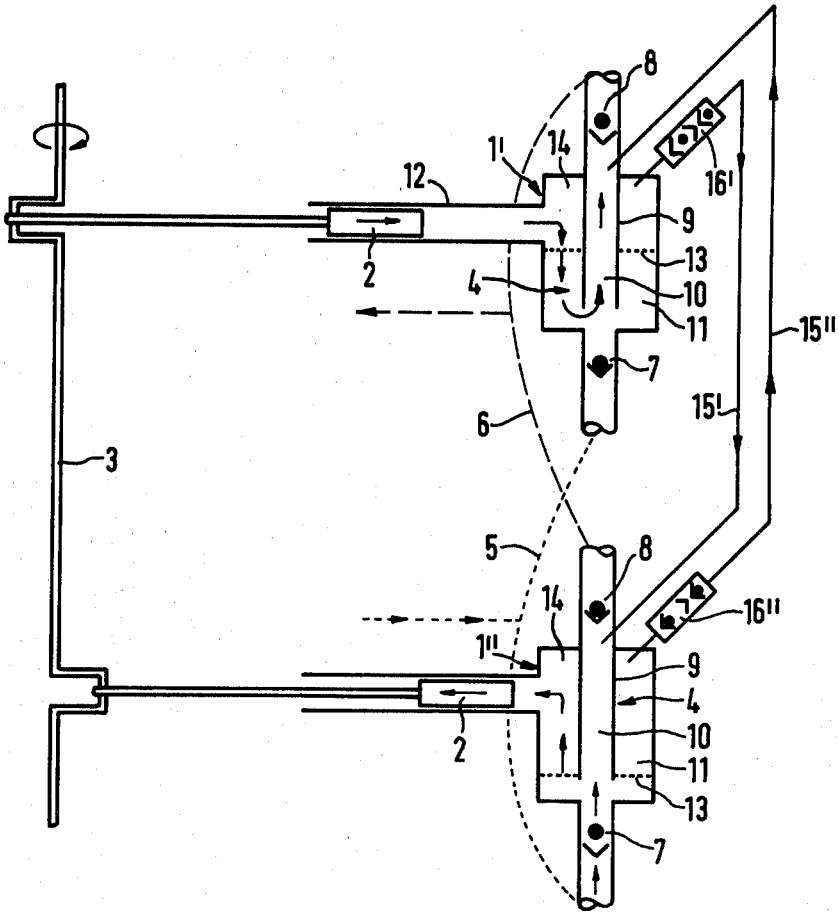
FIG. 2 is a schematic representation of a piston pump system with two pumping units each having reciprocating working spaces and venting each other.

FIG. 2 illustrates a pumping system having two piston pump units 1' and 1'' driven by a crankshaft 3 so that pistons 2 of each pump are phase shifted about 180° ($\pi$) whereby when one of the pistons is in its upper dead center point, the other piston is in its lower dead center point.

Each pumping unit 1' and 1'' has a working space 4 connected to a suction conduit 5 with a suction valve 7 and a discharge conduit 6 with a delivery valve 8.

Suction valve 7 and delivery valve 8 in each pumping unit are coaxially arranged one above the other. The delivery valve 8 is disposed in a pump section 9 extending toward the suction valve 7 separating the working space 4 into a central liquid discharging zone 10 in the interior of pipe 9 and an oscillating or reciprocating zone 11 surrounding the pipe 9 and communicating with the cylinder 12 for the corresponding piston 2. In the reciprocating space 11 is placed a separating liquid which is not mixable with the pumped medium and which transfers the reciprocating movement of the piston 2 against the pumped medium so that the piston and its seals are spaced apart from the pumped medium thus permitting the pumping of abrasive or aggressive liquids.

Between the separating liquid and the pumped medium an interface 13 is formed which performs a reciprocating movement in the space 11 in synchronism with the movement of the piston 2. At the beginning of the compression stroke the interface 13 is in its upper position (as seen in pump unit 1') and at the beginning of the suction stroke is in its lower position (pumping unit 1''). Losses of the separation liquid are compensated by a non-illustrated injection line opening into the working cylinder 12 of the piston 2.

When a medium is to be pumped which has a tendency to develop gas or vapors, then gas or vapor bubbles formed in the liquid discharge space 10 are advanced during the pressure phase of respective pumping units through the delivery valve 8 into the pressure conduit 6.

Gas or vapor bubbles developed in the reciprocating space 11 are accumulated in a collecting zone 14 in the upper part of the reciprocating space 11 where due to the inwardly projecting pipe section 9 remain trapped. In the course of the pumping operation the gas or vapor may increase in volume to such as extent as to occupy practically the entire reciprocating space 11 and due to their compressibility the operation of the pistons 2 can be seriously disturbed. To avoid this excessive accumulation of gases, venting conduits 15' and 15'' are provided between the collection zone 14 of the pump unit 1' and the liquid discharge zone 10 in the other pump unit 1'' where it opens below the delivery valve 8. Similarly, a parallel venting conduit 15'' is connected between the collecting zone 14 of the latter pumping unit 1'' into the liquid discharge zone 10 of the first mentioned pumping unit 1' where it also opens below or upstream of the delivery valve 8.

Both venting conduits 15' and 15'' are controlled so as to open only in response to a pressure drop in the conduit that means when the pump unit to be vented is in its compression phase.

In the most simple case this condition is fulfilled when each of the venting conduits 15' and 15'' is provided with a backpressure valve which opens in the venting direction and the conduits have a high flow resistance.

In the preferred embodiment, however, there are employed valve arrangements 16' and 16'' corresponding to the arrangement 16 in FIG. 1. In the illustration according to FIG. 2, the pumping unit 1' is in its compression phase during which the venting conduit 15' is momentarily opened by opening the valve arrangement 16'. The other pumping unit 1'' is in its suction phase in which the other venting conduit 15'' is closed due to the closing position of the valve arrangement 16''.

During the compression phase of the pumping unit 1'' and the suction phase of the pumping unit 1' the venting conduit 15'' is open whereas the conduit 15' remains closed.

Due to the pressure prop resulting from the momentary opening of the venting conduit 15'' and corresponding to the pressure difference in the two units 1' and 1'', the gases and vapors accumulating in the collecting zone 14 of the first pumping unit 1' are fed into the liquid discharging zone 10 of the other pumping unit 1'' where they accumulate below the delivery valve 8 during the suction phase and are discharged through the pressure conduit 6 during the subsequent compression phase.

In the pumping system of this invention, a continuous self-venting operation is insured during which a pump unit during its compression phase is vented by the other pump unit when the latter is in its suction phase.

Figure 3:
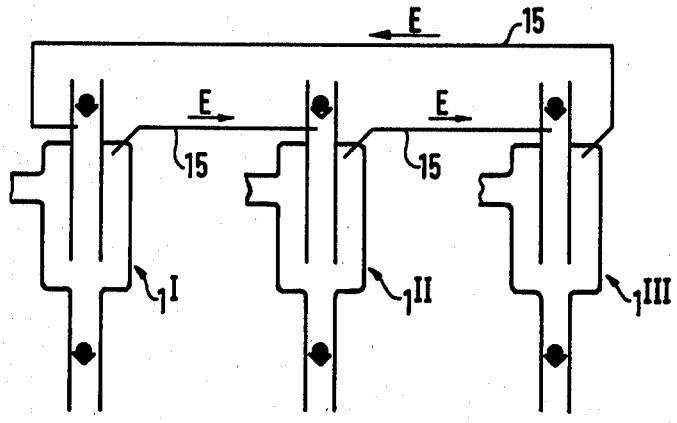
FIG. 3 is a schematic representation of the arrangement of venting conduits in pumping system having three cylinder-and-piston units.
Figure 4:
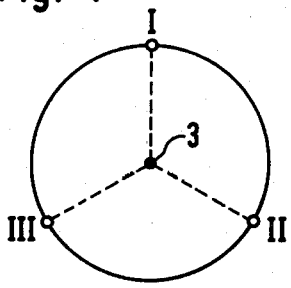
FIG. 4 shows schematically the arrangement of cranked portions of a crank shaft of the pump according to FIG. 3.

A modification of the system of FIG. 2 for three piston pump units 1I, 1II and 1III is shown in FIG. 3 and the relative position of respective cranks, I, II and III of the driving crank shaft is illustrated in FIG. 4. In this embodiment, in contrast to the embodiment of FIG. 2 where the pumping unit operates in opposite phases, the pumping unit 1I to 1III operate with a phase shift of $2\pi/3$. Due to the fact that the compression and suction phases in individual pumping units overlap each other, the resulting pressure differences insure a gas discharging operation of double-seat valves in venting conduits 15 in the same manner as disclosed in the embodiment of FIG. 2.

Figure 5:
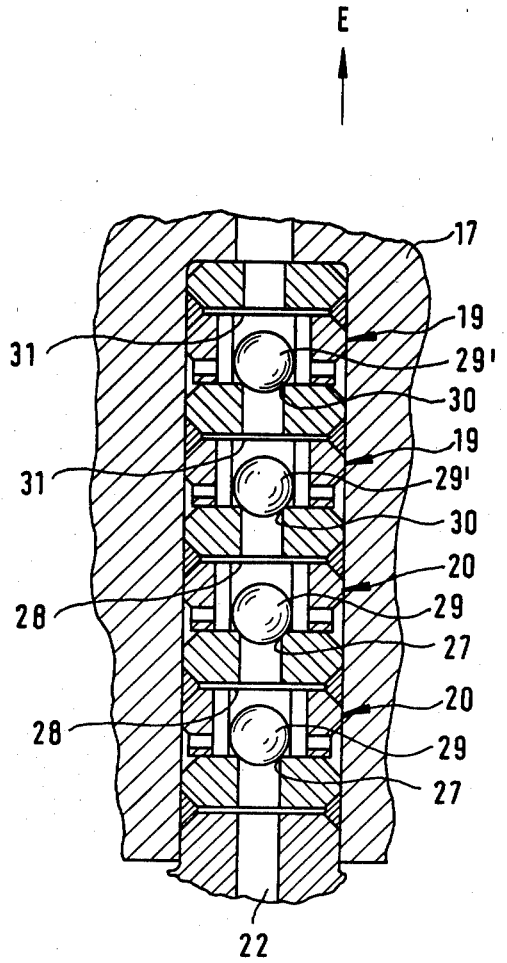
FIG. 5 shows in an axial section a portion of a modified version of the valve arrangement of FIG. 1, including two double-seat valves and two back pressure valves.

The valve arrangement according to FIG. 5 differs from that of FIG. 1 in the series arrangement of two double-seat valves 20 and two back pressure valves 19 in a single housing 17. Such a series arrangement is of advantage in the case when the pump operates with liquids that are polluted with solid particles which may cause transient leakage in individual valve elements.

In the embodiment according to FIG. 6, a back-pressure valve 190 and a double-seat valve 200 are located one above the other in housing 17 whereby each valve is formed with a disk-shaped, valving element 290 and 290'. The latter elements are spring biased in direction R into their respective closing positions on valve seats 270 and 300.

The valving element 290 of valve 200 is movable in bore 18 in pressure relieving direction E against the valve seat 280 which is formed on the same insert 302 as is the seat 300 for the back pressure valve 190. Valving element 290' of the latter valve, however, remains permanently open when displaced in the pressure relieving direction E against the notched rim 310 of the seat in insert 303. The valve seat 270 is formed in another insert 301 the position of which relative to housing 17 and to the opposite seat 280 is adjustable by means of spacers 304. Inserts 302 and 303 are fastened to housing 17 by screws 311, whereas insert 301 with spacers 304 is fixed in position by screws 312.

FIG. 7 illustrates an adjustable throttling arrangement 260 including a pipe 261 in which a butterfly valve or flap 262 is rotatable about an axle 263. This throttling arrangement 260 can replace the fixed throttle 26 in FIG. 1, if desired.

It will be understood that each of the elements described above, or two or more together, may also find a useful application in other types of constructions differing from the types described above.

While the invention has been illustrated and described as embodied in connection with piston type pumping aggregates, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pumping system for delivering a liquid developing gas or vapor, comprising a plurality of pump units each having a reciprocating pumping element operating at different phases, a working space formed with a gas or vapor collecting zone and a liquid discharging zone, a suction conduit with a suction valve, a pressure conduit with a delivery valve which is arranged in the liquid discharge zone, a venting conduit connected between the gas and vapor collecting zone of one pump unit and the liquid discharge zone of the subsequent pump unit, and a valve arrangement provided in each venting conduit for controlling the discharge of the gas or vapor from the collecting zone in response to the pressure difference between said working spaces.

2. A system as defined in claim 1, wherein the phase shift between respective pumping units interconnected by the venting conduits is between $\pi/2$ and $\pi$.

3. A system as defined in claim 1, wherein each pumping unit includes a reciprocating space filled with a separation liquid communicating with the corresponding piston of the unit to transfer reciprocating movement of the piston to the medium to be pumped.

4. A pump system as defined in claim 3, wherein said liquid discharging zone is bounded by a tubular member projecting into the working space of the pump unit and accommodating a delivery valve, and said gas and vapor collecting zone surrounding the tubular member and adjoining the reciprocating space.

5. A pumping system as defined in claim 1, wherein said valve arrangement includes a double seat valve with a valving element which is movable between a first closing position in which it rests on one seat and the valve is closed, an intermediate position between the seats in which the valve is momentarily open, and a second closing position in which it engages the other seat and the valve is closed.

6. A pumping system as defined in claim 5, further including a back pressure valve arranged in tandem with the double seat valve downstream of the latter when considered in venting direction.

7. A pumping system as defined in claim 5, further including a throttle arranged upstream of the double seat valve when considered in venting direction.

8. A pumping system as defined in claim 7, wherein the flow resistance of the throttle is adjustable.

9. A pumping system as defined in claim 6, wherein the double seat valve and/or the back pressure valve have respectively an adjustable stroke.

10. A pumping system as defined in claim 6, wherein the valving element of the double seat valve and/or of the back pressure valve are spring-biased in the back pressure direction.

11. A pumping system as defined in claim 6, wherein the valving elements of the double seat valve and of the back pressure valve are movable in the back pressure direction by the force of gravity.

12. A pumping system as defined in claim 6, wherein the valving elements of the double seat valve and/or of the back pressure valve are in the form of balls cooperating with valve seats of circular cross section.

13. A pumping system as defined in claim 6, wherein the valving elements of the double seat valve and/or of the back pressure valve have a plate-like configuration cooperating with corresponding flat valve seats.

14. A pumping system as defined in claim 6, wherein at least two double seat valves and back pressure valves are arranged in series to increase operational reliability of the system.

* * * * *